US008082989B2

(12) United States Patent
Kabishcher et al.

(10) Patent No.: US 8,082,989 B2
(45) Date of Patent: Dec. 27, 2011

(54) METHOD FOR IMPULSE STIMULATION OF OIL AND GAS WELL PRODUCTION

(75) Inventors: Gennadi Kabishcher, Beer Sheva (IL); Yuri Ass, Beer Sheva (IL)

(73) Assignee: Flow Industries Ltd., Omer (IL)

( * ) Notice: Subject to any disclaimer, the term of this patent is extended or adjusted under 35 U.S.C. 154(b) by 0 days.

(21) Appl. No.: 12/977,379

(22) Filed: Dec. 23, 2010

(65) Prior Publication Data

US 2011/0088905 A1 Apr. 21, 2011

Related U.S. Application Data

(63) Continuation-in-part of application No. 12/229,006, filed on Aug. 19, 2008, now Pat. No. 7,882,895.

(51) Int. Cl.
*E21B 43/26* (2006.01)
*E21B 28/00* (2006.01)

(52) U.S. Cl. ..... 166/249; 166/252.1; 166/263; 166/308.1; 166/370; 166/372

(58) Field of Classification Search ..... None
See application file for complete search history.

(56) References Cited

U.S. PATENT DOCUMENTS

| | | | |
|---|---|---|---|
| 3,672,449 | A | 6/1972 | Richardson et al. |
| 4,683,951 | A | 8/1987 | Pathak et al. |
| 5,120,935 | A | 6/1992 | Nenniger |
| 5,297,631 | A | 3/1994 | Gipson |
| 5,452,763 | A | 9/1995 | Owen |
| 5,463,164 | A | 10/1995 | Perkins |
| 5,836,393 | A | 11/1998 | Johnson |
| 6,015,010 | A | 1/2000 | Kostrov |
| 6,250,388 | B1 | 6/2001 | Carmi et al. |
| 6,460,618 | B1 | 10/2002 | Braithwaite et al. |
| 2006/0065400 | A1 | 3/2006 | Smith |
| 2006/0108111 | A1 | 5/2006 | Kas'yanov |
| 2007/0107902 | A1 | 5/2007 | Jelsma |
| 2007/0193737 | A1 | 8/2007 | Miller et al. |

FOREIGN PATENT DOCUMENTS

| | | |
|---|---|---|
| UA | 70007 | 9/2004 |

*Primary Examiner* — Zakiya W Bates
(74) *Attorney, Agent, or Firm* — Robert G. Lev; Michael Factor

(57) ABSTRACT

A method for improving liquid injection into a rock formation. The method includes the steps of introducing a gas impulse device into a wellbore in the formation and pumping a pressurized liquid into the wellbore. The method also includes firing the gas impulse device periodically so that the device generates impulses of high pressure compressed gas. The gas expands through the pumped pressurized liquid substantially instantaneously increasing the liquid flow rate into the rock formation, and creates rapid cyclical injected liquid surges into the rock formation with liquid oscillation occurring inside the fractures and/or pores of the formation. The method may be used in regular oil production applications, waterflooding of wells that have ceased to be productive, in preventing lost circulation in oil wells, and in injecting hazardous wastes into rock formations.

28 Claims, 9 Drawing Sheets

METHOD FOR IMPULSE STIMULATION OF OIL AND GAS WELL PRODUCTION

CROSS REFERENCE TO RELATED APPLICATION

The present application is a continuation-in-part application of U.S. patent application Ser. No. 12/229,006, filed Aug. 19, 2008, and claims priority therefrom.

FIELD OF INVENTION

The present invention relates to stimulating and improving hydrocarbon flow in oil, gas and coal bed-methane (CBM) wells.

BACKGROUND OF THE INVENTION

Air impulse apparatuses or air guns for use in water well rehabilitation are widely known. In theory, these apparatuses should be usable for stimulating and improving hydrocarbon flow in oil, gas or coal bed-methane (CBM) bearing rock formations. In practice, however, these apparatuses have only rarely been used for oil and gas well completion, stimulation and maintenance, despite the fact that the fossil fuel energy industry could benefit from the application of such technology.

Current methods for stimulating hydrocarbon flow in oil, gas, or CBM rock formations are based on conventional hydrofracturing techniques. These require pumping a liquid into an oil, gas or CBM well at a pressure and flow rate high enough to split the rock and to create cracks in the rock formation around the borehole (wellbore). The hydrostatic pressure increases slowly until the resistance of the rock is overcome and the formation's fracturing pressure is reached. The pressure applied in conventional hydrofracturing is non-cyclic.

Some prior art fracturing techniques for oil wells include using a gas impulse device to assist in well stimulation. However, current fracturing techniques using such devices are not entirely satisfactory when applied to oil, gas or CBM wells. They are also unsatisfactory for stimulating water wells. For example, one apparatus and method used does not provide enough energy to extend the fractures within an oil or gas bearing formation out to reasonable distances from the wellbore. Fractures that have been opened after firing the gas impulse apparatus tend to close after the impulse is spent. The gas impulse device must then reopen the same fractures after each firing without the length of the fracture substantially increasing.

Some oil well fracturing techniques when employing a gas impulse device produce very little effect, since most of the energy provided by the impulse device is dissipated in displacing a fluid column in the wellbore and in overcoming the resistance of the wellbore-formation face.

There is therefore a need in the fossil fuel energy industry for a more efficient method for stimulating and improving hydrocarbon flow in oil, gas and CBM wells, when using gas impulse devices.

SUMMARY OF THE INVENTION

An object of the present invention is to provide a method for improving hydrocarbon flow in oil, gas and coal-bed methane (CBM) wells and for production stimulation therein.

Another object of the present invention is to provide a method for stimulation, rehabilitation, development, completion and maintenance of oil, gas and CBM wells using an air or gas impulse device.

Yet another object of the present invention is to provide a method that requires fewer pumps than are used in a conventional hydrofracturing process and, in general, is more economical.

Still another object of the present invention is to provide a method which reduces the problems resulting from preferred flow pathways as occur in conventional hydrofracturing procedures.

Yet another object of the present invention is to provide a method for secondary recovery of hydrocarbons employing waterflooding.

Yet another object of the present invention is to provide a method for improving injection of liquids into wells.

Another object of the present invention is to provide a method for waste disposal and isolation by injection of hazardous, industrial and municipal wastes into rock formations.

Still another object of the present invention is to provide a method to prevent lost circulation.

In a first aspect of the present invention, there is provided a method for fracturing an oil or gas formation. The method includes the following steps: introducing a gas impulse device into a wellbore; pumping a pressurized liquid into a wellbore at a pressure lower than an estimated fracturing pressure of the oil or gas formation; and firing the gas impulse device periodically so that the device generates impulses of high pressure compressed gas or "blasts" which when the gas expands through the pumped pressurized liquid substantially instantaneously increases the liquid flow rate into the oil or gas formation causing the total pressure to exceed the actual fracturing pressure of the formation thereby to initiate or to extend fractures in the formation stimulating the flow of the oil or gas therefrom into the wellbore.

In an embodiment of the method, the method further includes the step of placing one or more packing elements into the wellbore. In yet another embodiment of the present invention, the method further includes the step of positioning one or more deflector elements below the one or more packing element in the wellbore, the one or more deflector elements forming a damper chamber between the one or more deflector elements and the one or more packing elements, the chamber operative to dampen the impact of the compressed gas impulses.

In yet another embodiment of the method, the method further includes the step of estimating the fracturing pressure of the formation. The pressure of the pumped liquid is from about 25% to about 100% of the estimated fracturing pressure. In some embodiments, the pressure of the pumped liquid is from about 25% to about 70% of the estimated fracturing pressure. In yet another embodiment, the compressed gas pressure of the impulse is at least 10 bars greater than the pumped liquid pressure.

In a further embodiment of the method the liquid that is pumped in the step of pumping is an acidic liquid.

In still another embodiment of the method, the step of pumping includes the step of adding one or more types of proppant to the pressurized fracturing liquid being pumped.

In a further embodiment of the method, when the well is a coal bed-methane well, the step of firing generates a stress on the coal matrix and the cleat methane. The methane is first compressed and then expands within the matrix. During its expansion, the methane creates a cavity around the wellbore.

In a second aspect of the present invention there is provided a method for fracturing an oil and gas formation. The method includes the following steps: placing one or more packing elements into a wellbore and positioning one or more deflector elements below the one or more packing elements in the wellbore, the one or more deflector elements forming a damper chamber between the one or more deflector elements and the one or more packing elements, the chamber operative to dampen the stress of the impact of compressed gas impulses on the one or more packing elements; introducing a gas impulse device into the wellbore; pumping a pressurized liquid into a wellbore at a pressure about equal to or lower than an estimated fracturing pressure of the oil or gas formation; and firing the gas impulse device periodically so that the device releases high pressure compressed gas impulses which when expanding through the pumped pressurized liquid substantially instantaneously increases the liquid flow rate into the oil or gas formation causing the total pressure to exceed the actual fracturing pressure of the formation thereby to initiate or to extend fractures in the formation stimulating the flow of the oil or gas therefrom into the wellbore.

In another embodiment of the method of the second aspect of the invention, the method further includes the step of estimating the fracturing pressure of the formation. In some embodiments, the pressure of the pumped liquid is from about 25% to about 100% of the estimated fracturing pressure. In still other embodiments, the pressure of the pumped liquid is from about 25% to about 70% of the estimated fracturing pressure.

In a third aspect of the present invention, there is provided a method for fracturing an oil or gas formation. The method includes the following steps: placing one or more packing elements into a wellbore and positioning one or more deflector elements below the one or more packing elements in the wellbore, the one or more deflector elements forming a damper chamber between the one or more deflector elements and the one or more packing elements, the chamber operative to dampen the stress of compressed gas impulses on the one or more packing elements; introducing a gas impulse device into the wellbore; pumping a pressurized liquid into a wellbore, wherein the pressure of the pressurized liquid is from about 25% to about 100% of an estimated fracturing pressure of the oil or gas formation; and firing the gas impulse device periodically so that the device generates impulses of high pressure compressed gas at a pressure at least 10 bars greater than the pumped liquid pressure, and when the compressed gas expands through the pumped pressurized liquid the impulse substantially instantaneously increases the liquid flow rate into the oil or gas formation causing the total pressure to exceed the actual fracturing pressure of the formation, thereby to initiate and to extend fractures in the formation stimulating the flow of the oil or gas therefrom into the wellbore.

In a fourth aspect of the present invention, there is provided a method for fracturing an oil or gas formation. The method includes the following steps: introducing a gas impulse device into a wellbore; pumping a pressurized liquid into a wellbore, wherein the pressure of the pressurized liquid is from about 25% to about 90% of an estimated fracturing pressure of the oil or gas formation; and firing the gas impulse device periodically so that the device generates impulses of high pressure compressed gas at a pressure at least 10 bars greater than the pumped liquid pressure, and when the compressed gas expands through the pumped pressurized liquid the impulse substantially instantaneously increases the liquid flow rate into the oil or gas formation causing the total pressure to exceed the actual fracturing pressure of the formation, thereby to initiate and to extend fractures in the formation stimulating the flow of the oil or gas therefrom into the wellbore.

In another embodiment of the method of the fourth aspect of the invention, the method further includes the step of placing one or more packing elements into the wellbore.

In yet another embodiment of the method of the fourth aspect of the invention, the method further includes the step of positioning one or more deflector elements below the one or more packing elements in the wellbore, the one or more deflector elements forming a damper chamber between the one or more deflector elements and the one or more packing elements, the chamber operative to dampen the stress of the impact of compressed gas impulses on the one or more packing elements.

In yet another aspect of the present invention there is provided a method for extracting residual oil in an oil formation. The method includes the following steps: introducing a gas impulse device into a wellbore where oil production has ceased; pumping a pressurized liquid into the wellbore; and firing the gas impulse device periodically so that the device generates impulses of high pressure compressed gas which when the gas expands through the pumped pressurized liquid substantially instantaneously increases the liquid flow rate into the oil formation causing the residual oil in fractures or pores of high flow resistance to flow toward and empty into nearby producing wells. Gas bubbles produced by the firing of a gas impulse device and introduced along with injected water into a rock formation which has substantially ceased production oscillate therein. This assists in displacing residual oil from the rock formation and displacing the residual oil towards production wells.

In yet another aspect of the present invention there is provided a method for preventing drilling fluid lost circulation. The method includes the following steps: introducing a gas impulse device into a wellbore the formation around which at least partially includes a drilling fluid "thief" zone; pumping a sealing slurry into the wellbore to cover at least a portion of the "thief" zone; firing the gas impulse device periodically so that the device generates impulses of high pressure compressed gas which when the gas expands through the slurry substantially instantaneously increases the slurry flow rate into the formation causing the fissured and porous regions of the formation to be sealed with sealant; and moving the device along the "thief" zones so that the gas impulse device is fired all along the zone and so that sealing slurry can enter all portions of the "thief" zone.

In yet another aspect of the present invention there is provided a method for improving liquid injection into a rock formation. The method includes the following steps: introducing a gas impulse device into a wellbore in the formation; pumping a pressurized liquid into the wellbore; and firing the gas impulse device periodically so that the device generates impulses of high pressure compressed gas which when the gas expands through the pumped pressurized liquid substantially instantaneously increases the liquid flow rate into the rock formation causing an improved liquid flow into the formation. In an embodiment of this method the pumped liquid is a liquid comprised of hazardous, industrial or municipal wastes.

In still another aspect of the present invention there is provided a method for extracting mineral material from a rock formation. The method includes the following steps: introducing a gas impulse device into a wellbore; pumping a pressurized liquid into the wellbore; and firing the gas impulse device periodically so that the device generates impulses of high pressure compressed gas which when the gas expands through the pumped pressurized liquid substantially instantaneously increases liquid agitation inside the formation and improves dissolution and leaching of the mineral materials.

In some embodiments of this aspect of the method of the invention, the mineral material is plugging material blocking pore throats in the rock formation matrix. In other embodiments of this aspect of the method of the invention, the pressurized liquid is an acidic liquid. In other embodiments, the pressurized liquid is a non-acidic liquid. In yet other embodiments of this aspect of the invention, the mineral material is comprised of one or more minerals useful for further industrial processing.

In another aspect of the present invention there is provided a method for improving liquid injection into a rock formation. The method includes the following steps: introducing a gas impulse device into a wellbore in the formation; pumping a pressurized liquid into the wellbore; and firing the gas impulse device periodically so that the device generates impulses of high pressure compressed gas which when the gas expands through the pumped pressurized liquid substantially instantaneously increases the liquid flow rate into the rock formation and creates rapid cyclical injected liquid surges into the rock formation with liquid oscillation occurring inside the fractures and/or pores of the formation. In some embodiments of the method of this aspect of the invention, the method further includes the step of monitoring the pressure or injection rate of the pressurized liquid. In some of these instances, the method also includes the step of adjusting the pressure or injection rate of the pressurized liquid based on the results of the step of monitoring. In other embodiments of the method of this aspect of the present invention, the method further includes the step of estimating the pressure or injection rate of the pressurized liquid required for improving liquid flow into the formation. The pressure or injection rate of the pumped pressurized liquid in the step of pumping ranges from about 25% to about 100% of the estimated injection pressure or injection rate and is periodically adjusted so that the pumped liquid pressure or injection rate remains in that range. The gas impulse device working pressure in the step of firing is at least 10 bars greater than the pumped injection liquid pressure. In yet other embodiments of the method of this aspect of the invention, the method further includes the step of monitoring the pressure of the compressed gas supplied to the gas impulse device. In some cases of this embodiment, based on the results of the step of monitoring, the pressure of the compressed gas supplied to the device is appropriately adjusted. In still another embodiment of the method of this aspect of the invention, the compressed gas of the step of firing forms bubbles oscillating between expansion and contraction within the pressurized liquid, thereby improving injected liquid flow distribution over the fractures and/or pores of the rock formation. In a further embodiment of the method of the present aspect of the invention, the step of pumping the liquid is pumping a liquid that comprises hazardous, industrial and/or municipal wastes.

In yet another embodiment of the method for improving liquid injection into a rock formation, the rock formation is an oil containing rock formation and the method further includes the step of monitoring oil production in one or more production wells of the rock formation. In an embodiment of the method for improving liquid injection when the rock formation is an oil containing rock formation, the method further includes the step of adjusting the pressure of the gas supplied to the gas impulse device based on the results of the step of monitoring oil production. In a further embodiment of the method when the rock formation is an oil containing rock formation, the method further includes the step of adjusting the pressure or injection rate of the pressurized liquid based on the results the step of monitoring oil production. In still another embodiment of the method of improved liquid injection when the rock formation is an oil containing rock formation, the method further includes the step of estimating the pressure or injection rate of the pressurized liquid required for improving liquid flow into the formation. In some instances of this embodiment, the pressure or injection rate of the pumped pressurized liquid in the step of pumping ranges from about 25% to about 100% of the estimated injection pressure or injection rate and the gas impulse device working pressure in the step of firing is at least 10 bars greater than the pumped injection liquid pressure and one or more of the following is periodically adjusted based on the results of the step of monitoring oil production: pressure of the compressed gas supplied to the gas impulse device; pressure of the pressurized injection liquid; and rate of injection of the pressurized injection liquid. In yet another embodiment when the rock formation is an oil containing rock formation, the compressed gas of the step of firing forms bubbles oscillating between expansion and contraction within the pressurized liquid, thereby improving oil displacement by the injected liquid inside the oil containing rock formation.

In yet another embodiment of the method for improving liquid injection in a rock formation outlined above, the method is employed for extracting residual oil in an oil formation in which oil production has substantially ceased. In that case, the step of introducing a gas impulse device into a wellbore, includes introducing the device into a wellbore in a formation where oil production has substantially ceased. The periodic firing of the gas impulse device generates impulses of high pressure compressed gas which when the gas expands through the pumped pressurized liquid substantially instantaneously increases the liquid pressurized flow rate into the oil formation causing residual oil found in fractures and/or pores of high flow resistance to flow toward, and empty into, nearby producing wells. In some embodiments of the method for improving liquid injection when used for extracting residual oil, the method may further include the step of monitoring the rate of discharged oil. The method further includes the step of adjusting the pressure of the gas supplied to the gas impulse device or the pressure or injection rate of the injected liquid based on the monitored rate of discharged residual oil. In yet another embodiment of the liquid injection method when used to recover residual oil, the method further includes the step of monitoring the pressure or injection rate of the injected liquid. In still another embodiment of the injection method when used to recover residual oil, the method further includes the step of adjusting the pressure or injection rate of the injected liquid based on the pressure or rate determined in the step of monitoring. In another embodiment of the method, the compressed gas in the step of firing forms oscillating bubbles, which periodically expand and contract within the injected pressurized liquid, thereby improving residual oil displacement from the formation that has substantially ceased production, the oil flowing towards a well that still is a producing well.

In still another embodiment of the method for improving liquid injection in a rock formation discussed above, the method may be used for preventing drilling fluid lost circulation in oil wells. In such cases, the formation in which the wellbore is located and into which the gas impulse device is introduced, at least partially, includes a drilling fluid "thief" zone. In the step of pumping a pressurized liquid, the pressurized liquid is a pressurized sealing slurry which when pumped into the wellbore covers at least a portion of the "thief" zone. In the step of firing the gas impulse device, the device expels gas which expands through the slurry substantially instantaneously increasing the slurry flow rate into the formation causing fissured and porous regions of the formation to be sealed with the sealant slurry. In some embodiments of the method when used to prevent lost circulation, the method further includes the step of moving the device along the "thief" zone so that the gas impulse device is fired all along the zone so that sealing slurry can enter the fissures and porous regions throughout all portions of the "thief" zone. When used to prevent lost circulation, the method may further include the step of monitoring one or more of the following: the pressure of the pumped pressurized sealing slurry; the injection rate of the pumped pressurized sealing slurry; and the density of the pressurized sealing slurry. In yet another embodiment of the injection method relating to lost circulation, the method further includes the step of periodically adjusting one or more of the following: the pressure of the pressurized sealing slurry; the injection rate of the pressurized sealing slurry; and the density of the pressurized sealing slurry where the adjustment is based on the pressure, rate, and/or density determined in the step of monitoring. In another embodiment of the liquid injection method when used to prevent lost circulation, in the step of firing, the device expels gas which expands through the slurry substantially instantaneously increasing the slurry flow rate and creates rapid cyclical injected liquid surges into the rock formation with liquid oscillation occurring inside the fractures and/or pores of the formation.

BRIEF DESCRIPTION OF THE FIGURES

The present invention will be more fully understood and its features and advantages will become apparent to those skilled in the art by reference to the ensuing description, taken in conjunction with the accompanying drawings, in which.

DETAILED DESCRIPTION OF THE PREFERRED EMBODIMENTS OF THE INVENTION

The present invention is a method for improving hydrocarbon fluid flow in oil and gas wells and stimulation of their production. The invention includes: (a) positioning a gas impulse device against a predefined face of a wellbore; (b) continuously pumping a fracturing liquid into the wellbore at a predetermined pressure; (c) cyclically firing the gas impulse device which emits an impulse, that is a "blast", of gas thereby generating a pressure impulse at a predetermined pressure and transmitting the pressure impulse at predetermined intervals for predetermined durations in the form of a shock wave. The shock wave is followed by liquid mass displacement of the pumped fracturing liquid resulting from the expansion and contraction of one or more gas bubbles generated by the impulse. The periodic liquid displacement of the continuously pumped liquid opens and extends fractures in the hydrocarbon bearing rock formation. The predefined face of the wellbore may typically include the region of the wellbore containing the wellbore's casing perforations, or the region of the wellbore containing a well screen for supporting a gravel pack positioned around the wellbore or even the wellbore-rock formation interface itself.

The present invention is also applicable to stimulate methane production in coal bed-methane formations. Everywhere that oil and gas wells are discussed, the discussion herein applies equally to coal bed-methane wells *mutatis mutandis* except where specifically noted to the contrary.

The method of the present invention can be adapted for injecting a sealing slurry to seal off a "thief" zone in an oil bearing formation thereby preventing lost circulation. It can also be adapted for use with waterflooding when recovery of residual oil is desired. The method can also be used for improved waste management by injecting hazardous industrial or municipal waste deep into underground rock formations.

Figure 1:
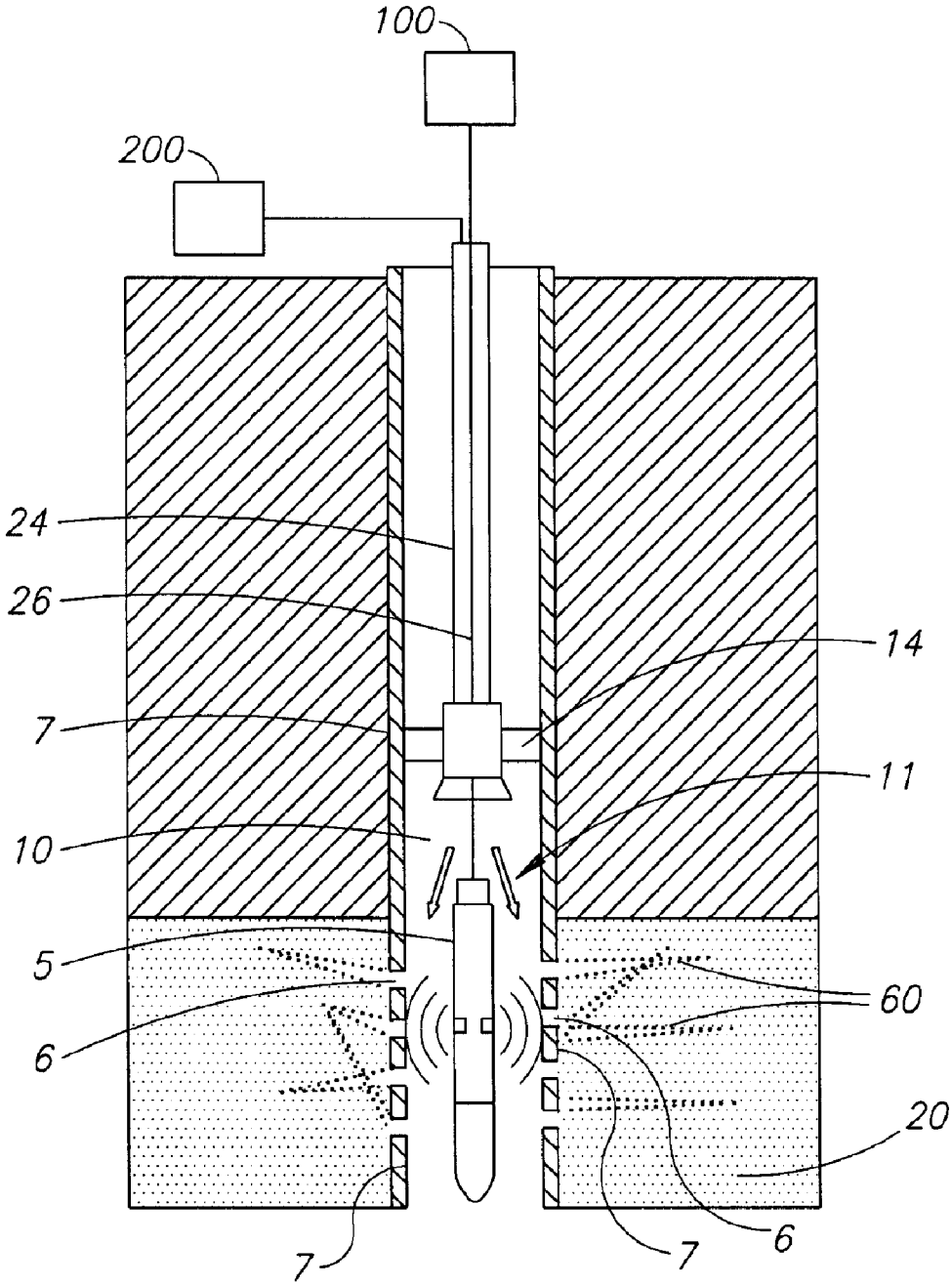
FIG. 1 illustrates the positioning and use of a gas impulse device in a wellbore according to an embodiment of the present invention.

Reference is now made to FIG. 1 which illustrates positioning a gas impulse device in a wellbore according to an embodiment of the present invention.

Gas impulse device 5 is lowered into a wellbore 10. Fracturing liquid 11 is supplied from a surface fracturing liquid source 200 and pumped to the zone of wellbore 10 near that portion of a rock formation to be fractured. Liquid 11 is supplied through a piping 24 with at least one packer 14, also sometimes referred to herein as a packer element, positioned substantially concentrically about piping 24 within substantially circular wellbore 10. Packer 14 hydraulically seals and isolates the zone of wellbore 10 near that portion of the rock formation 20 to be fractured. Packer 14 assists in containing the fracturing liquid 11 within the isolated zone even when the liquid is subject to gas impulses which cause the liquid to, at least partly, flow in directions substantially parallel to the long axis of wellbore 10. Packer 14 may be constructed from one or more materials known to persons skilled in the art.

In another embodiment of the present invention, the fracturing liquid may be supplied directly through a pipe such as piping 24 into wellbore 10 but without any packer element present, sealing of wellbore 10 being effected only at the wellhead.

In some embodiments the pumped fracturing liquid enters wellbore 10 directly from pipe 24 and does not pass through device 5. In other embodiments of the invention, the fracturing liquid may enter wellbore 10 through apertures (not shown) in device 5.

High-pressure gas is supplied to gas impulse device 5 from a surface gas source 100. A pipeline 26 within piping 24 feeds the compressed gas supply from source 100 to gas impulse device 5. Typically, but without intending to limit the invention, pipeline 26 may be in the form of a high-pressure hose, metal piping or coil tubing.

The impulse generated by gas impulse device 5 creates a pressure impulse of a predetermined pressure and duration at predetermined intervals. The amplitude of the pressure impulse generated by gas impulse device 5 is, typically, greater than the pumping pressure of fracturing liquid 11.

The pressure impulse generated by gas impulse device 5 is transmitted through fracturing liquid 11 in the wellbore in the form of a shock wave. This is followed by mass displacement of fracturing liquid 11 resulting from the expanding gas bubble generated by device 5. As will be discussed below in conjunction with FIGS. 3A-4, the gas bubble expands to a maximum size and then contracts.

According to one embodiment of the present invention, gas impulse device 5 is positioned at a preselected region of wellbore 10. As noted above, it may be positioned against i) a region of the wellbore casing 7 containing perforations 6, or ii) against a region of the wellbore containing a support screen (not shown) for a gravel pack (not shown) surrounding wellbore 10, or iii) substantially adjacent to the wellbore-rock formation interface itself. It should be noted that in some embodiments gas impulse device 5 may be placed at the level of the production zone of the well; in other embodiments, device 5 may be positioned at a level above the production zone of the well.

After positioning gas impulse device 5 in wellbore 10, fracturing liquid 11 is continuously pumped at a predetermined pressure into wellbore 10 through pipe 24 and at substantially the same time, gas impulse device 5 is activated so as to deliver gas pressure impulses at pressures greater than the liquid pumping pressure. The pumping pressure of the fracturing liquid is typically preselected depending upon an estimation of the oil or gas formation's fracturing pressure. The pumping pressure of the fracturing liquid may be as high as 1400 bars but preferably it is the range from about 100 bars to about 650 bars, and even more preferably in the range from about 100 bars to about 400 bars.

In the method of this invention, the pumping pressure of the fracturing liquid is typically less than the estimated fracturing pressure of the rock formation. The fracturing pressure may be reasonably estimated because fracturing pressure in oil or gas bearing rock formations is a function of formation depth which has been found typically to increase at a known fairly linear rate. This is because most rock formations that contain gas or oil deposits are geologically similar.

A typical gas impulse device which may be used in the present invention is discussed in U.S. Pat. No. 6,250,388 to Carmi et al, herein incorporated by reference. This is an exemplary device only and it is not intended to limit the invention. Such a device is commercially available from Flow Industries Ltd., Omer, Israel. Other gas impulse devices known to those skilled in the art may also be used.

In an embodiment of the present invention, but without intending to limit the invention, the gas impulse device may have a diameter in the range of about 1.5" to about 3.7". The gas pressure supplied may range from a pressure of about 100 bars to about 1000 bars, more preferably from about 100 bars to about 700 bars, and even more preferably from about 100 bars to about 500 bars.

The impulse created by the gas impulse device is characterized by a number of parameters such as time of impulse rise, impulse pressure amplitude, impulse duration, volume of released gas, and impulse frequency. It has been found that impulse rise time for a given device is a constant value that does not vary with changes in gas pressure or gas volume. It has also been found that impulse frequency is minimally important for the procedure. The most significant parameters for the successful application of the method of this invention are impulse pressure amplitude and volume of released gas. This is because the main effect of the method is continuous cyclical fracturing liquid mass displacement with simultaneous gas bubbles pushing into the oil, gas or coal formation. Gas volume per impulse needed for the successful application of this method depends on the size of the gas impulse device used and the geological conditions of the oil, gas or coal formation. The gas receiving chamber of the impulse device is, typically but without intending to limit the invention, at least 2 liters for a 1.5" device and 4 liters for a 3.7" device. Impulse durations may range from about 50 milliseconds to about 300 milliseconds. In some embodiments the impulse durations may exceed 300 milliseconds.

Figure 2:
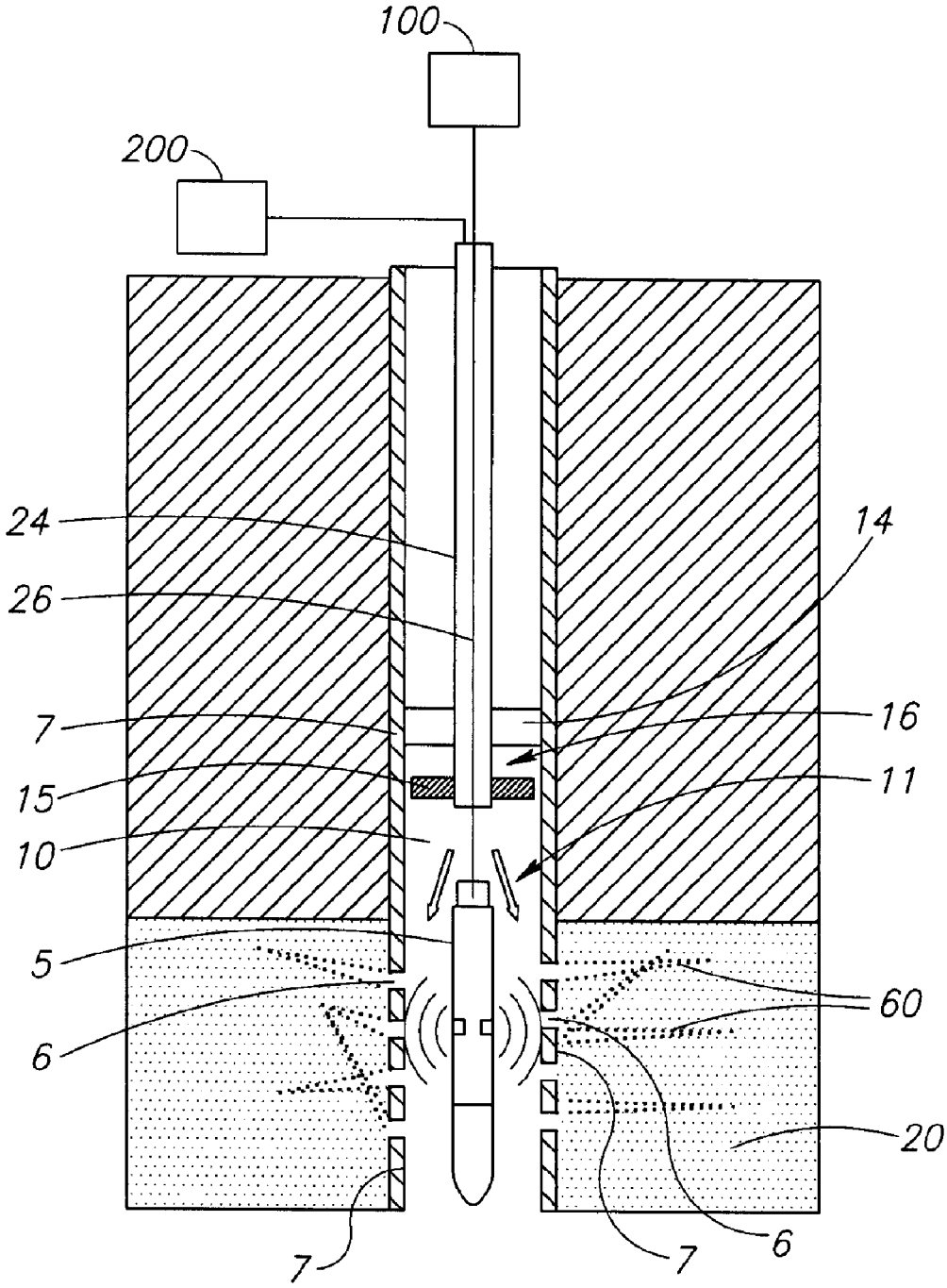
FIG. 2 illustrates the positioning and use of a gas impulse device in a wellbore according to a second embodiment of the present invention.

Reference is now made to FIG. 2 which presents another embodiment of the present invention. The embodiment in FIG. 2 is very similar to that described in conjunction with FIG. 1. The elements common to both Figures are numbered similarly and since their construction and operation are substantially identical, the common elements will not be described in detail again.

FIG. 2 shows an embodiment of the present invention which employs one or more packers 14 of FIG. 1 together with at least one deflector element 15. The latter is typically, but without limiting the invention, installed on piping 24. As noted in FIG. 1, fracturing liquid 11 is pumped into the oil or gas well from surface fracturing liquid source 200 via piping 24. Deflector 15 is arranged and positioned for energy concentration thereby protecting packer 14 from impulse stresses as discussed below. Deflector 15 is positioned at a distance from packer 14 creating a damper chamber 16. Typically, but without intending to limit the invention, the deflectors are made of metal and they may be welded to piping 24. Other materials and methods of attachment known to persons skilled in the art may also be used. When gas impulse device 5 is first fired, part of the emitted gas moves into damper chamber 16 and is not carried by fracturing liquid 11 into the oil and gas bearing rock formation. During subsequent firings of gas impulse device 5, the gas in damper chamber 16 attenuates the pressure impulses and stresses impinging on packer 14.

The behavior of the shock wave and compressed gas bubble generated upon firing a gas impulse device and moving within the pumped fracturing liquid will now be described in conjunction with FIG. 1 and FIGS. 3A-4, to which reference is now made.

A shock wave 55 produced upon activating gas impulse device 5 creates a sharp pressure rise. After the generation of shock wave 55 shown in FIG. 3A, an initial substantially spherical bubble 51—the pressure behavior in the formation fracture at this stage is shown as section 306 of the pressure-time graph in FIG. 4—extends in a horizontal direction, that is, typically in a direction transverse to the long axis of wellbore 10. At this stage, the force vectors of the flowing fracturing liquid 11 and the expanding bubble 51 act substantially in the same direction, that is, the direction indicated by arrows B. These vectors are substantially additive.

It should be noted that most of the shock wave energy is lost at the wellbore-formation interface. According to measurements, the shock wave pressure loss is greater than 90% immediately beyond the interface and has little effect on opening or extending fractures.

Figures 3A, 3B, 3C:
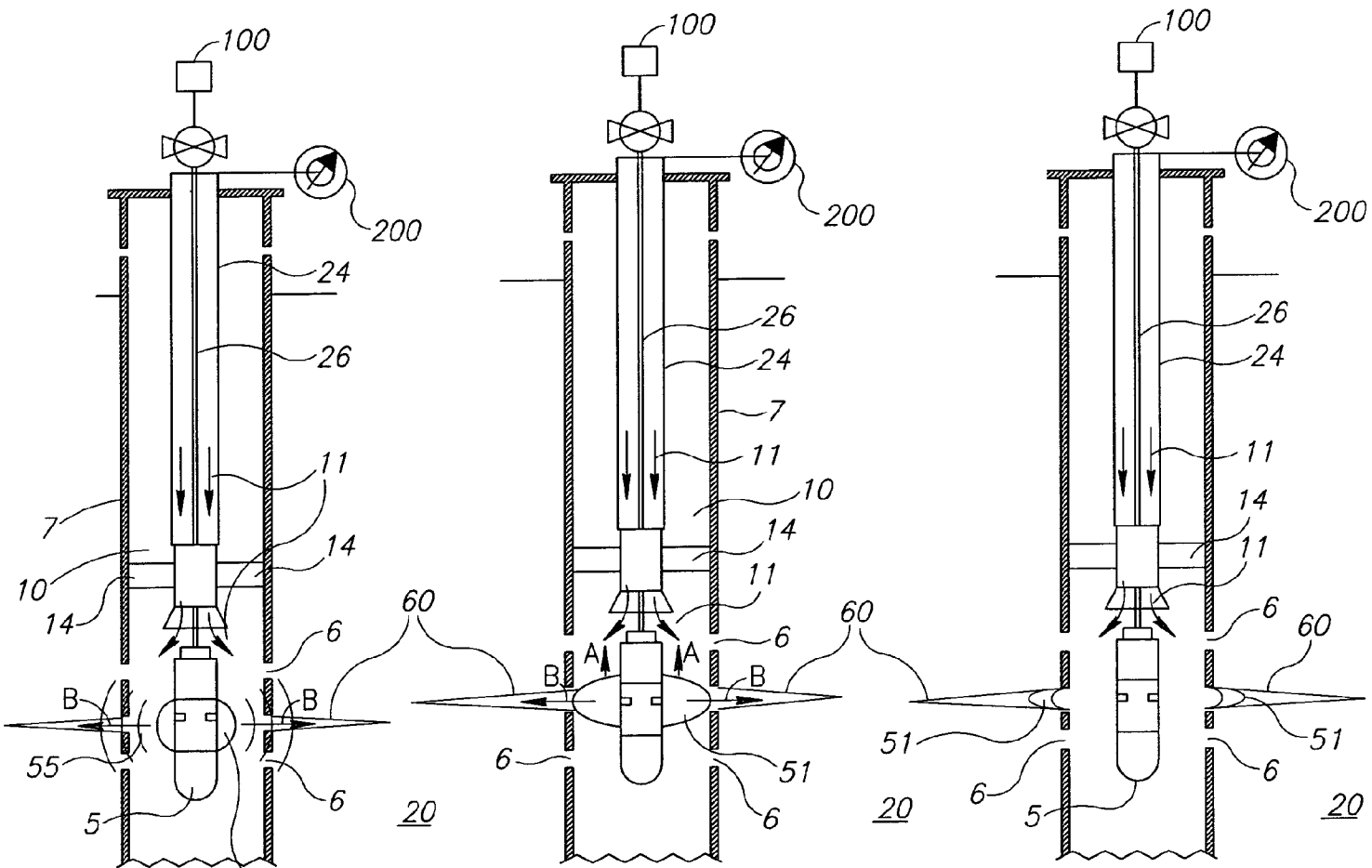
FIGS. 3A-3E illustrate the behavior of a gas bubble moving through a fracturing liquid at various stages after production of a gas impulse according to the method of the present invention.
Figure 4:
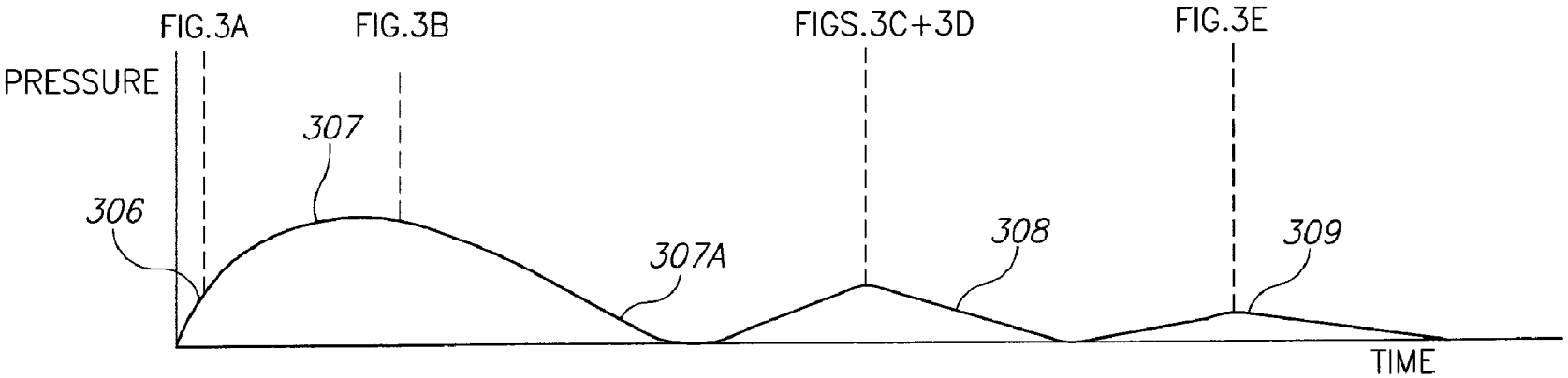
FIG. 4 shows a graph of pressure as a function of time after production of a gas bubble by a gas impulse according to an embodiment of the present invention.

As bubble 51 grows (FIG. 3B)—the pressure behavior in the formation fracture at this stage is shown as 307 of the pressure-time graph in FIG. 4—its growth in the A direction is stopped by the hydrostatic pressure of the essentially incompressible liquid being pumped into wellbore 10. The result of the gas bubble generated in FIG. 3A is that fracturing liquid 11 is pushed through perforation 6 of wellbore 10 into fractures 60 of rock formation 20 extending existing fractures and initiating new ones. The pumped fracturing liquid 11 flows in the direction (arrow B) transverse to the long axis of the wellbore and undergoes a sharp surge into fracture 60. As noted above, the gas pressure and volume of the gas bubble are the primary determinants of the volume of liquid surging into the fracture.

Eventually, the fracturing liquid in wellbore 10 fully or partially stops because of resistance of the gas bubble. At the end of the expansion phase of bubble 51 as shown in FIG. 3C, the potential energy of the bubble has completely converted into kinetic energy of the moving gas so that the pressure in bubble 51 dramatically drops. During this drop in bubble pressure, less fluid is pushed into the formation, and accordingly, the pressure in the fracture decreases. The pressure behavior in the formation fracture at this stage is shown as 307A of the pressure-time graph in FIG. 4 Immediately after bubble 51 reaches its maximum expansion, the compressed liquid above bubble 51 starts pushing the bubble which begins contracting into fractures 60 of formation 20 (FIG. 3C).

The numerous gas bubbles 51 pushed into fracture 60 undergo compression by the fracturing liquid 11 until the bubbles' pressure increases the pressure of the fracturing liquid. At this stage, the pressure in the bubbles is greater than the pressure in the fracturing liquid, and the bubbles start expanding inside the fracture causing oscillation of the fluid moving into the fractures. The pressure behavior in the formation fracture at this stage is shown as sections 308 and 309 of the pressure-time graph in FIG. 4. With each subsequent impulse, the cycle described above is repeated.

As shown and described, the method of the present invention provides for rapid cyclical fracturing liquid surges into the fractures with liquid oscillation occurring inside the fractures between the surges. Liquid flow is directed only from the wellbore towards the fractures. The fracturing liquid never moves from the fracture back into the wellbore because of a contracting bubble as in prior art. In prior art, in at least one stage of the cycle the fracturing liquid moves into the fracture and at a second stage the fracturing liquid moves out of the fracture.

FIG. 4, to which reference is now made, shows a graph of pressure P in the pumped fracturing liquid/compressed gas system over time t for a gas bubble generated by a gas impulse produced by a gas impulse device according to the method of the present invention. It indicates that only the expanding bubble causes the fracturing liquid to surge into the fractures of the rock formation, creating the fluid mass displacement in the fracture that serves to open, initiate or extend the fracture. FIG. 4 shows the pressure of the gas bubbles formed by the gas impulse device during the entire process and is cross-referenced to the stages in the process shown in FIGS. 3A-3E.

As the pressure of the compressed fluid presses down on the gas bubble generated by the impulse after the bubble's expansion stage, the bubble is driven further into the fracture.

Figures 3D, 3E:
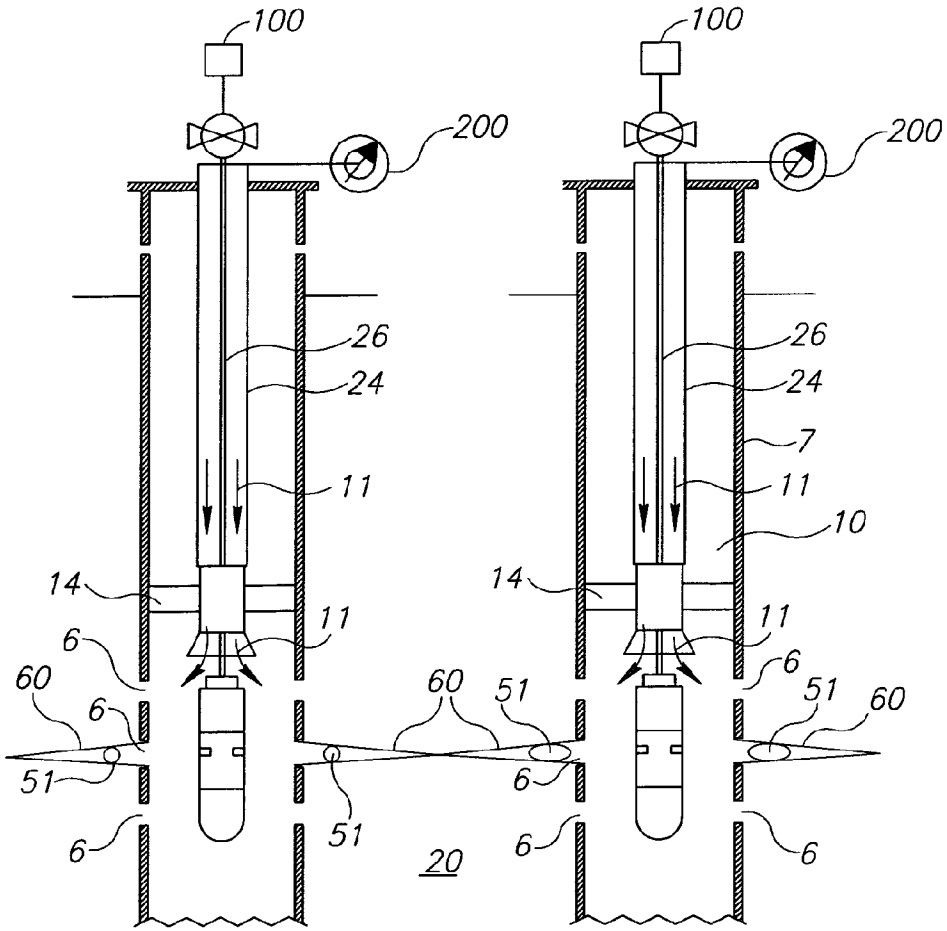

As the compressed gas bubble is further compressed and then expands an oscillatory wave in FIGS. 3C, 3D and 3E occurs which is represented by section 308 and 309 of the graph in FIG. 4. This section represents an oscillatory wave resulting from the expansion and contraction of the gas bubble produced by the gas impulse device as the bubble moves into and along the fracture within the rock formation. Each subsequent activation of the gas impulse device provides another rapid fracturing liquid surge and the gas bubble pressure profile shown in FIG. 4 is repeated.

The efficiency of a sharp fracturing liquid surge into a rock formation as taught by the present invention is illustrated by the following example.

EXAMPLE 1

Two 1300 kW pumps are used to pump 50 l/sec of fracturing liquid into a wellbore, creating a well pressure of 400 bars. A gas impulse device fires 2 liters of compressed gas at a pressure of 500 bars during the pumping of the fracturing liquid. The duration of the gas impulse is very short, for example 50 msec. The gas bubble produced expands to about 2.5 liters (volume of the expanded gas=500×2/400) for 50 msec. This is equivalent to an almost instantaneous increase in pumping capacity of an additional 50 l/sec. It effectively doubles the fracturing liquid discharged into the fracture in the oil or gas formation to 100 l/sec for the duration of the impulse. The discharge is very effective in extending a fracture into the oil or gas formation and does not require a large number of pumps to create a pressure peak. Additionally, the "almost" instantaneous increase in pressure resulting from the firing of the gas impulse device can not be produced by pumps alone.

The efficiency of the method depends primarily on the differential pressure between the pressure at which the fracturing liquid is pumped and the pressure at which the gas impulses are emitted rather than on any absolute working pressure. For example, if the pumped fracturing liquid pressure is 250 bar, the gas impulse device working pressure should be at least 10 bar greater than the pumped fracturing liquid pressure to achieve the effects described herein.

The pumped liquid pressure may be equal to or less than the fracturing pressure, but, in practice, it is typically less than fracturing pressure.

Typically, in conventional prior art, the hydrofracturing liquid is pumped at the fracturing pressure. In the method of this invention, the fluid is pumped at pressures below the fracturing pressure, typically between about 25% to almost 100% of the fracturing pressure. Even more preferably, the pressure of the pumped fracturing liquid may be between about 25% to about 70% of the fracturing pressure of the rock formation.

In a typical example of the method of the present invention, since the pressure of the expanding bubble is effectively superimposed on the pressure created by the pumped fracturing liquid, the latter may be at lower pressures than the fracturing pressure. The ability to use a fracturing liquid which is pumped at below fracturing pressure is unexpected and non-obvious. In the present invention, fractures are extended by surges of the pumped fracturing liquid. Additionally, unlike conventional hydrofracturing, there is a decreased need for a large assemblage of pumps.

As noted above, the pumping of a pressurized fracturing liquid with simultaneous generation of gas pressure impulses allows for the fracturing liquid to move only uni-directionally into the fractures of an oil, gas or coal formation. Additionally, pumping a fracturing liquid at a pressure equal to that of the fracturing pressure is possible just as in prior art. However, the use of a combination of pumped pressurized fracturing liquid together with a periodic gas impulse allows for the fracturing liquid to be pumped at pressures lower, often significantly lower, than fracturing pressures.

It should be apparent to persons skilled in the art that the selection of a fracturing liquid for pumping and a pressure at which to operate the gas impulse device depends on the nature and conditions of the oil or gas bearing rock formation being fractured.

Figure 5:
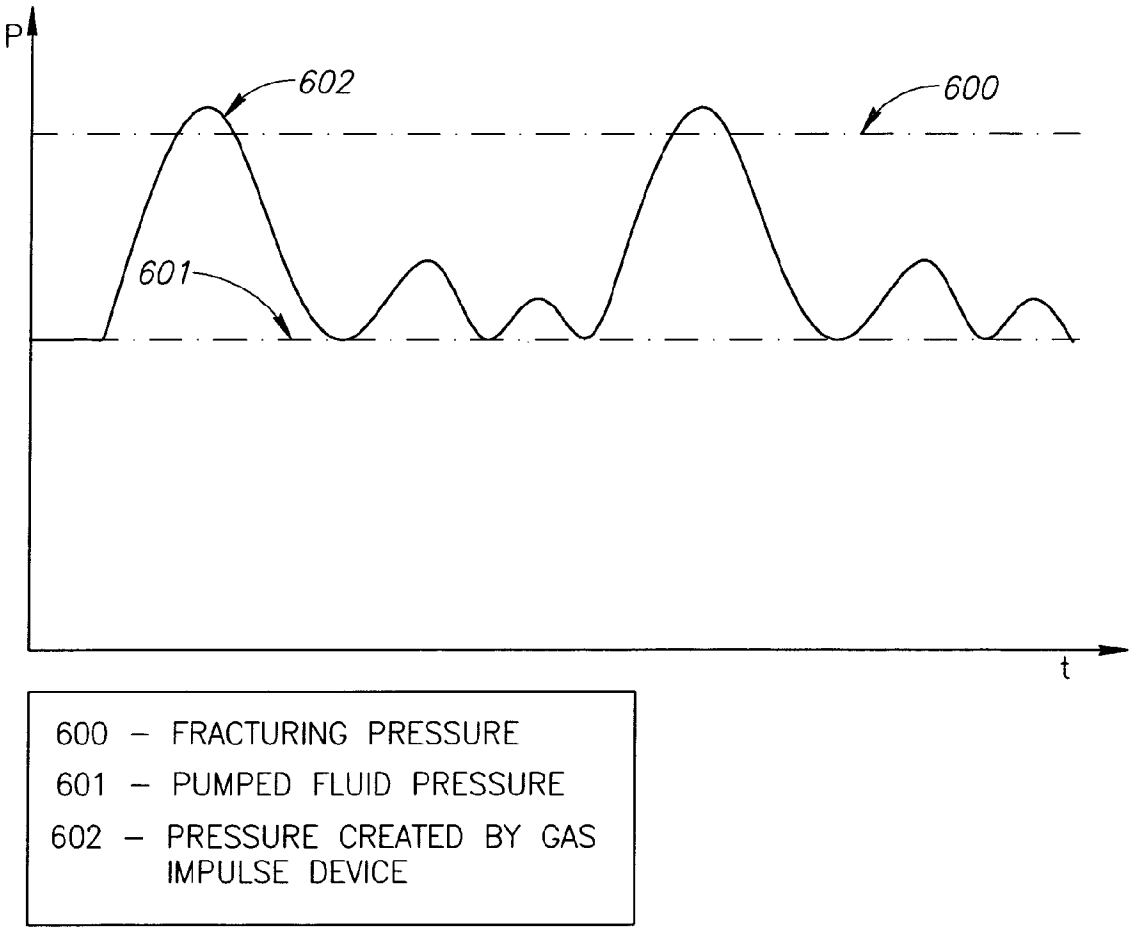
FIG. 5 illustrates the combination of the gas impulse pressure produced by a gas impulse device and the pumped fracturing liquid pressure produced by the pumped liquid according to embodiments of the present invention.

FIG. 5, to which reference is now made, illustrates, typical, but non-limiting, pressure profiles of the pumped fracturing liquid and of the gas pressure impulses generated by a gas impulse device operative in accordance with the present invention during a hydrofracturing process.

FIG. 5 illustrates a hydrofracturing process where the pumped fracturing liquid pressure profile 601 is lower than the fracturing pressure 600 of the oil or gas bearing rock formation. Gas pressure spikes 602 are generated when a gas impulse device is operated. These are superimposed on the pumped fracturing liquid pressure profile 601.

The combined effect of the pumped fracturing liquid and the gas pressure impulses shown in FIG. 5 initiates fractures immediately adjacent to, or in the vicinity of, the gas impulse device. It also extends fractures much deeper in the formation. The effects also assist in widening already existing fractures. As discussed further below, this combination of effects also overcomes a well-known problem found with prior art conventional hydrofracturing methods where a fracturing liquid flows principally through preferred flow pathways.

Preferential flow is fluid flow through preferential flow pathways, that is, pathways having high fluid permeability, and, accordingly, lower fluid flow resistance. Because of the slow gradual pressure increase during conventional prior art hydrofracturing, fluid moves principally through these preferred pathways or zones. As a result, only zones of relatively higher permeability are stimulated. Zones of higher flow resistance receive less fracturing liquid flow. Fractures are therefore often formed far from the desired oil or gas-bearing zones of a rock formation.

The sudden pressure rise (602 in FIG. 5) created by a rapid fracturing liquid surge in accordance with the method of the present invention is very effective in overcoming this preferential pathway limitation. It provides a more economical and effective approach in the use of hydrofracturing processes. It allows for greater control of initiation and extension of fractures in a rock formation. This is very important since post-fracture reservoir productivity is governed to a large extent by the precise location of a fracture.

During conventional hydrofracturing, fracturing liquid leaks into the rock formation to be fractured. The procedure requires a constantly increasing amount of pressurized fracturing liquid as the fracture extends. A large number of high capacity pumping units working together is needed to provide the required high pressure. A benefit of the present invention is that fewer and lower capacity pumps are required, making the procedure much more economical.

Another embodiment of the method of the present invention employs an acidic liquid for acidizing an oil or gas bearing rock formation. Acidizing is a rock formation matrix treatment involving the pumping of an acidic liquid at pressures below the formation's fracturing pressure. The objective of such injections is either to dissolve material that is blocking the pore throats in the rock formation matrix or to create new pathways that bypass near-wellbore blockage. Acids that may be used include hydrochloric acid, hydrofluoric acid, organic acids, or a combination of these or other acids.

When using an acidic liquid as the pumped fracturing liquid, there still exists the problem of the liquid entering preferred flow pathways. This is overcome as discussed above by using a gas impulse device. The shock wave creates microcracks in the formation and the expansion of the resulting gas bubble pushes acid over the "acid-rock formation" contact surface. Acid will enter not only the pathways of relatively high fluid conductivity but also enter newly created or existing pathways of relatively low fluid conductivity.

A problem which occurs in acidizing treatment is the decrease in concentration over time of the acid in the liquid layer adjacent to the face of the oil or gas bearing formation. The activation of a gas impulse device promotes uniform acid distribution throughout the formation. Mass displacement resulting from the firing of a gas impulse device creates turbulent acid flow and good mixing between acid layers.

Additionally, use of a gas impulse device is more economical than prior art methods, since a controlled volume of acid liquid may be precisely placed. There is also less waste of acid liquid since there is a decrease in the amount of liquid that enters a rock formation through the preferred flow pathways of a rock formation.

The method of formation acidizing is applicable not only to oil bearing rock formations but also for dissolving and extracting minerals such as uranium, salt, copper, and sulfur, via a technique known as in-situ leaching (ISL) or borehole mining.

Figure 6:
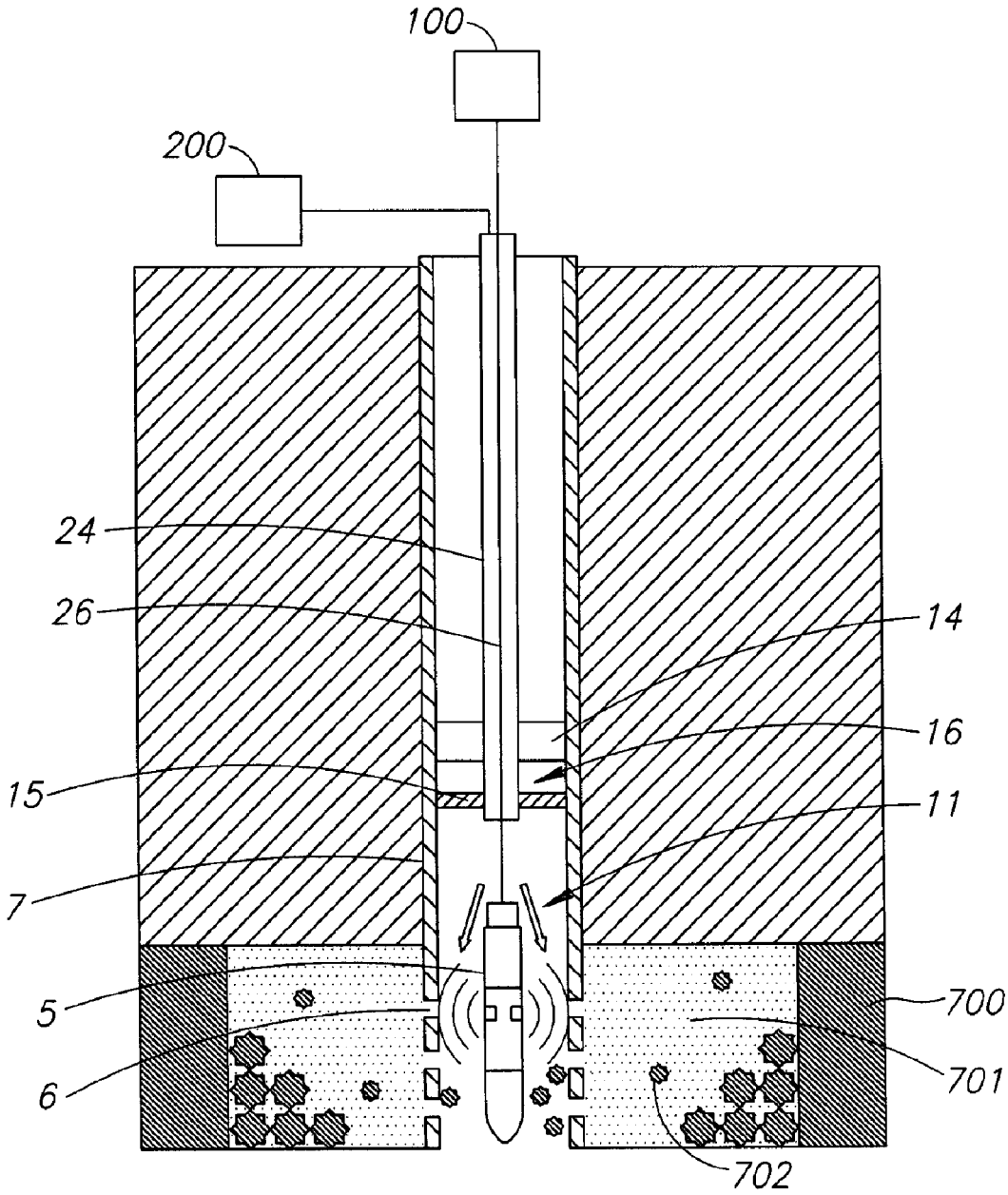
FIG. 6 illustrates the fracturing of coal bed-methane (CBM) wells according to an embodiment of the present invention.

Reference is now made to FIG. 6 where another use for the method of the present invention is shown. The embodiment in FIG. 6 is very similar to that described in conjunction with FIGS. 1 and 2. The elements common to all the Figures are numbered similarly and since their construction and operation are substantially identical, the common elements will not be described in detail again.

FIG. 6 illustrates the application of the method of the present invention for fracturing coal bed-methane (CBM) formations. The method includes creation of a cavity in the coal seam. Use of the method for fracturing CBM formations is similar to use of the method for fracturing oil and gas formations. The method employs continuously pumping a fracturing liquid and providing pulsed gas impulses which generate sudden pressure changes in the coal bed-methane matrix.

An expanding gas bubble produced by the discharge of a gas impulse device as described in FIGS. 3A-3E, moves through a fracturing liquid pumped into the CBM well quickly compressing the methane present in the coal bed matrix. This may occur in a period as short as several milliseconds. As the bubble starts contracting, the compressed methane gas rapidly expands rupturing the seam in coal bed 700.

The gas impulse device cyclically produces impulses every several seconds. Coal does not resist tensile stress well, and in the presence of the cyclic compressive and tensile stresses caused by the impulses and methane bubbles, the coal matrix bursts creating a cavity 701. The process is controlled by adjusting the ratio between the static (pumped fracturing liquid) and dynamic (impulse) pressures described above, so as to prevent the coal matrix from bursting too rapidly. Coal particles 702 produced when the methane bubbles burst through the coal matrix may be washed from the wellbore either at the same or at a later stage of production.

During hydrofracturing of oil and gas wells, it is common to place particulate materials, or proppants, into the formation as a filter medium and/or as a propping agent. These materials are placed in the near-wellbore region and/or in fractures of the rock formation extending outward from the wellbore. The proppants prevent collapse of newly formed fractures when the fracturing procedure is completed.

In an embodiment of the present invention, proppants may be pumped into the fractures of the rock formation together with the fracturing liquid forming a heterogeneous liquid/solid mixture. Typical proppants which may be used include, but are not limited to, sand, plastic beads and glass particles.

In order to properly distribute the proppants in the fractures that are opened and to ensure that they enter the fractures as far from the well bore as possible, the proppant/fracturing liquid heterogeneous mixture is pushed into fractures using impulses provided by a gas impulse device.

When the device is fired as shown in FIGS. 1-6 and as discussed in conjunction therewith above, the solid proppant/fracturing liquid heterogeneous mixture is expelled from the wellbore deep into existing fractures or fractures newly opened in the formation by the gas impulse and fracturing liquid discharge. Without such impulses, the proppants would not travel deeply into the fractures. Furthermore, the impulses produce a relative uniform distribution of the proppant within the fractures, ensure the proppant's entering the tips of the fractures, provide for better proppant packing and prevent proppant flowback after the fracturing procedure.

The method of distributing the proppant is similar to that discussed above. It is to be understood that in the present embodiment the pressurized fracturing liquid discussed previously also carries proppant materials. Wherever previously described that the fracturing liquid enters or generates fractures in a formation, it is to be understood that the proppant enters the fractures along with its carrier fracturing liquid.

An additional embodiment of the method in accordance with the present invention employs impulses produced by a gas impulse device for prevention of lost circulation.

One of the most costly and time-consuming drilling and cementing problems is lost circulation caused by drilling mud or cement quantities being absorbed by the oil-bearing formation. This usually occurs in cavernous, fissured, or coarsely permeable zones. It is often encountered when a drill bit passes through porous or fractured formations and as a result, in many cases, the drilling operations must be interrupted until these formations can be sealed and drilling can be resumed.

In order to treat problems arising from lost circulation, many different materials have been used or proposed to seal fractured formations. Often these materials are various slurries that are effectively heterogeneous solid/liquid mixtures, the solid inter alia including cements, clays, synthetic or natural polymers or combinations thereof.

These materials for preventing lost circulation are generally applied by pumping them down to the zone of circulation loss in the form of a slurry. Sometimes pumping is not enough to provide fast, economical and effective sealing in the loss circulation zone. In many cases the cementing, i.e. sealing, fluid has a higher viscosity than the drilling or formation fluid. Uniform introduction of the cementing (sealing) fluid into a porous or fractured media filled by a fluid of lower viscosity may be a challenge and therefore there is a need for a method for forcing the particulate sealing materials in the slurry into the porous and/or fractured media.

Figure 7:
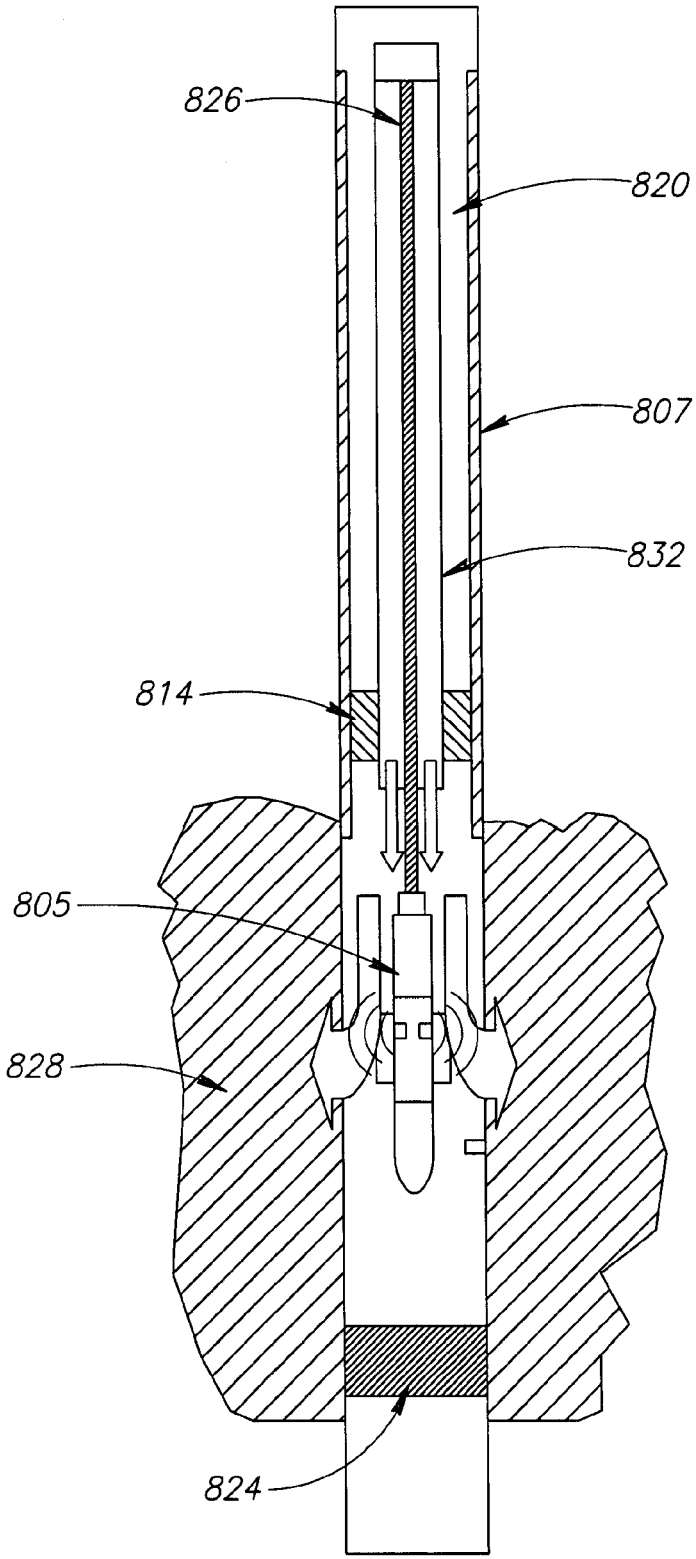
FIG. 7 illustrates the positioning and use of a gas impulse device in a wellbore according to an embodiment of the present invention for preventing lost circulation.

Reference is now made to FIG. 7 where the environment around a wellbore 820 suffering from lost circulation is shown. Gas impulse device 805 is lowered to the drilling fluid "thief" zone 828. Device 805 is connected via coil tubing 826 to a pressurized air source (not shown). Around coil tubing 826 is workstring 832 through which the sealant slurry is pumped from a particulate/liquid slurry source (not shown). Packer elements 814 and a cement plug 824 may be present to isolate the region to be sealed from the remainder of wellbore 820. Wellbore 820 typically has a casing 807 and gas impulse device 805 is positioned below casing 807 against the open wall.

Device 805 is fired and operated as discussed in conjunction with FIGS. 1-6 above. The effect of the impulses generated by firing the gas impulse device is to force the sealing slurry into pores and fractures (not shown) of the "thief" zone sealing them. Gas impulse device 805 can be moved up and down in wellbore 820 adjacent to the "thief" zone as often and as quickly or as slowly as required, with a firing rate adjusted to effect sealing of the zone.

In yet another embodiment of the method of the present invention, the method is used for waterflooding. Waterflooding is a method of secondary recovery in which water is injected into the reservoir formation to displace residual oil. The water from injection wells physically sweeps the residual oil outward toward nearby wells.

During waterflooding water is injected into wells that have ceased production. The wells into which water is pumped become injection wells, which introduce water into the reservoir. This water moves some of the residual oil that remains in the rock toward nearby producing wells in the same reservoir. The oil and water is then pumped up and out of the producing wells.

In general, pores or fractures in a reservoir that are filled with oil have lower relative permeability than pores or fractures without oil. That makes the path through oil filled pores and fractures particularly resistive. The favorable relative permeability of pores and fractures without oil make them the more attractive flow paths. This, as is known in the art, leads to fingering and channeling as water moves over paths of least resistance in the porous media.

Using the method of the present invention, water is pumped through the injection well into formations exactly as described in the fracturing process above in conjunction with FIGS. 1-6. The gas impulse device is then fired, producing a bubble which expands and pushes water into the fractures and pores of the formation.

Use of the method of the present invention in waterflooding operations helps in overcoming fingering. The injected fluid is periodically suddenly accelerated by the gas bubble and is pushed even into paths of relatively low conductivity. Entering into the formation with the liquid, the gas bubbles oscillate the injected pressurized water and further assist in overcoming fingering.

The method of the present invention is also useful for injecting hazardous, industrial and municipal wastes into wells for their disposal and isolation. The method outlined above for waterflooding can readily be adapted to deposit waste deep within a rock formation. The difference between this waste management application and that of waterflooding is that the waste is not pumped out from the formation well but left there for long-term isolation.

It should be evident to one skilled in the art that the methods disclosed herein can be applied to stimulating aqueous flow in water wells.

As noted above, gas impulse devices, including air guns, for use in water well rehabilitation are widely known. These apparatuses can be useful for improving liquid injection into rock formations. The following is a description of a method for improving injection of a liquid into a rock formation as provided by the present invention.

Reference is now again made to FIG. 1 which illustrates positioning a gas impulse device in a wellbore according to an embodiment of the present invention.

Gas impulse device 5 is lowered into a wellbore 10. Injection liquid 11 is supplied from a surface injection liquid source 200 and pumped to the zone of wellbore 10 near that portion of a rock formation. Injection liquid 11 is supplied through a piping 24 with at least one packer 14, also sometimes referred to herein as a packer element, positioned substantially concentrically about piping 24 within substantially circular wellbore 10. Packer 14 hydraulically seals and isolates the zone of wellbore 10 near that portion of the rock formation 20. Packer 14 assists in containing the injection liquid 11 within the isolated zone even when the liquid is subject to gas impulses which cause the liquid to, at least partly, flow in directions substantially parallel to the long axis of wellbore 10. Packer 14 may be constructed from one or more materials known to persons skilled in the art.

In another embodiment of the present invention, the injection liquid may be supplied directly through a pipe such as piping 24 into wellbore 10 but without any packer element present, sealing of wellbore 10 being effected only at the wellhead.

In some embodiments the pumped injection liquid enters wellbore 10 directly from pipe 24 and does not pass through device 5. In other embodiments of the invention, the injection liquid may enter wellbore 10 through apertures (not shown) in device 5.

High-pressure gas is supplied to gas impulse device 5 from a surface gas source 100. A pipeline 26 within piping 24 feeds the compressed gas supply from source 100 to gas impulse device 5. Typically, but without intending to limit the invention, pipeline 26 may be in the form of a high-pressure hose, metal piping or coil tubing.

The impulse generated by gas impulse device 5 creates a pressure impulse of a predetermined pressure and duration at predetermined intervals. The amplitude of the pressure impulse generated by gas impulse device 5 is, typically, greater than the pumping pressure of injection liquid 11.

The pressure impulse generated by gas impulse device 5 is transmitted through injection liquid 11 in the wellbore in the form of a shock wave. This is followed by mass displacement of injection liquid 11 resulting from the expanding gas bubble generated by device 5. As will be discussed below in conjunction with FIGS. 3A-4, the gas bubble expands to a maximum size and then contracts.

According to one embodiment of the present invention, gas impulse device 5 is positioned at a preselected region of wellbore 10. As noted above, it may be positioned against i) a region of the wellbore casing 7 containing perforations 6, or ii) against a region of the wellbore containing a support screen (not shown) for a gravel pack (not shown) surrounding wellbore 10, or iii) substantially adjacent to the wellbore-rock formation interface itself. It should be noted that in some embodiments gas impulse device 5 may be placed at the level of the injection zone of the well; in other embodiments, device 5 may be positioned at a level above the injection zone of the well.

After positioning gas impulse device 5 in wellbore 10, injection liquid 11 is continuously pumped at a predetermined pressure into wellbore 10 through pipe 24 and at substantially the same time, gas impulse device 5 is activated so as to deliver gas pressure impulses at pressures greater than the liquid pumping pressure. The pumping pressure of the injection liquid is typically preselected depending upon an estimation of the oil formation's conditions. The pumping pressure of the injection liquid may be as high as 1400 bars but preferably it is the range from about 50 bars to about 650 bars, and even more preferably in the range from about 100 bars to about 300 bars.

A typical gas impulse device which may be used in the present invention is discussed in U.S. Pat. No. 6,250,388 to Carmi et al, herein incorporated by reference. This is an exemplary device only and it is not intended to limit the invention. Such a device is commercially available from Flow Industries Ltd., Omer, Israel. Other gas impulse devices known to those skilled in the art may also be used.

In an embodiment of the present invention, but without intending to limit the invention, the gas impulse device may have a diameter in the range of about 1.5" to about 3.7". The gas pressure supplied may range from a pressure of about 100 bars to about 1000 bars, more preferably from about 100 bars to about 700 bars, and even more preferably from about 100 bars to about 350 bars.

The impulse created by the gas impulse device is characterized by a number of parameters such as time of impulse rise, impulse pressure amplitude, impulse duration, volume of released gas, and impulse frequency. It has been found that impulse rise time for a given device is a constant value that does not vary with changes in gas pressure or gas volume. It has also been found that impulse frequency is minimally important for the procedure. The most significant parameters for the successful application of the method of this invention are impulse pressure, amplitude and volume of released gas. This is because the main effect of the method is continuous cyclical injection liquid mass displacement with simultaneous gas bubbles pushing into the oil, gas or coal formation. Gas volume per impulse needed for the successful application of this method depends on the size of the gas impulse device used and the geological conditions of the oil, gas or coal formation. The gas receiving chamber of the impulse device is, typically but without intending to limit the invention, at least 2 liters for a 1.5" device and 4 liters for a 3.7" device. Impulse durations may range from about 50 milliseconds to about 300 milliseconds. In some embodiments the impulse durations may exceed 300 milliseconds.

In some embodiments of the method for improving injection of a liquid into a rock formation, packers 14 may not be needed.

Reference is again made to FIG. 2 which presents another embodiment of the present invention. The embodiment in FIG. 2 is very similar to that described in conjunction with FIG. 1. The elements common to both Figures are numbered similarly and since their construction and operation are substantially identical, the common elements will not be described in detail again.

FIG. 2 shows an embodiment of the present invention which employs one or more packers 14 of FIG. 1 together with at least one deflector element 15. The latter is typically, but without limiting the invention, installed on piping 24. As noted in FIG. 1, injection liquid 11 is pumped into the oil or gas well from surface injection liquid source 200 via piping 24. Deflector 15 is arranged and positioned for energy concentration thereby protecting packer 14 from impulse stresses as discussed below. Deflector 15 is positioned at a distance from packer 14 creating a damper chamber 16.

Typically, but without intending to limit the invention, the deflectors are made of metal and may be welded to piping 24. Other materials and methods of attachment known to persons skilled in the art may also be used. When gas impulse device 5 is first fired, part of the emitted gas moves into damper chamber 16 and is not carried by injection liquid 11 into the oil and gas bearing rock formation. During subsequent firings of gas impulse device 5, the gas in damper chamber 16 attenuates the pressure impulses and stresses impinging on packer 14.

In some embodiments of the method for improving injection of a liquid into a rock formation, packers 14 and deflectors 15 may not be needed.

The behavior of the shock wave and compressed gas bubble generated upon firing a gas impulse device and moving within the pumped injection liquid will now be described in conjunction with FIG. 1 and FIGS. 3A-4, to which reference is now again made.

A shock wave 55 produced upon activating gas impulse device 5 creates a sharp pressure rise. After the generation of shock wave 55 shown in FIG. 3A, an initial substantially spherical bubble 51—the pressure behavior in the formation fracture and/or pore at this stage is shown as section 306 of the pressure-time graph in FIG. 4—extends in a horizontal direction, that is, typically in a direction transverse to the long axis of wellbore 10. At this stage, the force vectors of the flowing injection liquid 11 and the expanding bubble 51 act substantially in the same direction, that is, the direction indicated by arrows B. These vectors are substantially additive.

As bubble 51 grows (FIG. 3B)—the pressure behavior in the formation fracture and/or pore at this stage is shown as 307 of the pressure-time graph in FIG. 4—its growth in the A direction is stopped by the hydrostatic pressure of the essentially incompressible liquid being pumped into wellbore 10. The result of the gas bubble generated in FIG. 3A is that injection liquid 11 is pushed through perforation 6 of wellbore 10 into fracture and/or pore 60 of rock formation 20 extending existing fractures and/or pores and initiating new ones. The pumped injection liquid 11 flows in the direction (arrow B) transverse to the long axis of the wellbore and undergoes a sharp surge into fracture and/or pore 60. As noted above, the gas pressure and volume of the gas bubble are the primary determinants of the volume of liquid surging into the fractures and/or pores.

Eventually, the injection liquid in wellbore 10 fully or partially stops because of resistance of the gas bubble. At the end of the expansion phase of bubble 51 as shown in FIG. 3C, the potential energy of the bubble has completely converted into kinetic energy of the moving gas so that the pressure in bubble 51 dramatically drops. During this drop in bubble pressure, less fluid is pushed into the formation, and accordingly, the pressure in the fractures and/or pores decreases. The pressure behavior in the formation fractures and/or pores at this stage is shown as 307A of the pressure-time graph in FIG. 4 Immediately after bubble 51 reaches its maximum expansion, the compressed liquid above bubble 51 starts pushing the bubble which begins contracting into fracture and/or pores 60 of formation 20 (FIG. 3C).

The numerous gas bubbles 51 pushed into fractures and/or pores 60 undergo compression by the injection liquid 11 until the bubbles' pressure increases the pressure of the injection liquid. At this stage, the pressure in the bubbles is greater than the pressure in the injection liquid, and the bubbles start expanding inside the fractures and/or pores causing oscillation of the fluid moving into the fractures and/or pores. The pressure behavior in the formation fractures and/or pores at this stage is shown as sections 308 and 309 of the pressure-time graph in FIG. 4. With each subsequent impulse, the cycle described above is repeated.

As shown and described, the method of the present invention provides for rapid cyclical surges of injection liquid into the fractures and/or pores with liquid oscillation occurring inside the fractures and/or pores between the surges. Liquid flow is directed only from the wellbore towards the fractures and/or pores.

FIG. 4, to which reference is now again made, shows a graph of pressure P in the pumped injection liquid/compressed gas system over time t for a gas bubble generated by a gas impulse produced by a gas impulse device according to the method of the present invention. It indicates that only the expanding bubble causes the injection liquid to surge into the fractures and/or pores of the rock formation, creating the fluid mass displacement in the fractures and/or pores. FIG. 4 shows the pressure of the gas bubbles formed by the gas impulse device during the entire process and is cross-referenced to the stages in the process shown in FIGS. 3A-3E.

As the pressure of the compressed fluid presses down on the gas bubble generated by the impulse after the bubble's expansion stage, the bubble is driven further into the fractures and/or pores.

As the compressed gas bubble is further compressed and then expands an oscillatory wave in FIGS. 3C, 3D and 3E occurs which is represented by section 308 and 309 of the graph in FIG. 4. This section represents an oscillatory wave resulting from the expansion and contraction of the gas bubble produced by the gas impulse device as the bubble moves into and along the fractures and/or pores within the rock formation. Each subsequent activation of the gas impulse device provides another rapid injection liquid surge and the gas bubble pressure profile shown in FIG. 4 is repeated.

The efficiency of the method depends primarily on the differential pressure between the pressure at which the injection liquid is pumped and the pressure at which the gas impulses are emitted rather than on any absolute working pressure. For example, if the pumped injection liquid pressure is 250 bar, the gas impulse device working pressure should be at least 10 bar greater than the pumped injection liquid pressure to achieve the effects described herein.

It should be apparent to persons skilled in the art that the selection of a pressure at which to operate the gas impulse device depends on the nature and conditions of the oil formation.

Figure 8:
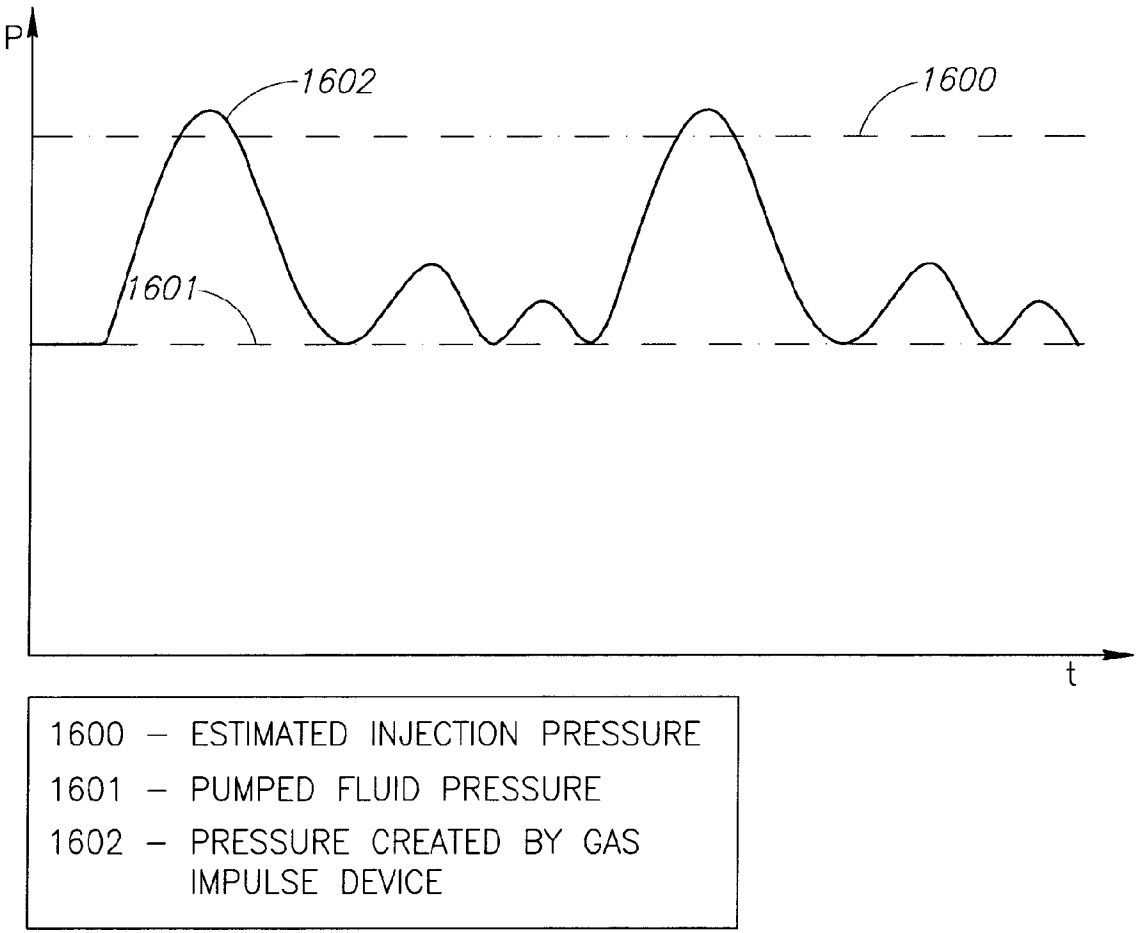
FIG. 8 illustrates the combination of the gas impulse pressure produced by a gas impulse device and the injected liquid pressure in relation to an estimated required injection pressure.

FIG. 8, to which reference is now made, illustrates, typical, but non-limiting, pressure profiles of the pumped injection liquid and of the gas pressure impulses generated by a gas impulse device operative in accordance with the present invention during an improved liquid injection process.

FIG. 8 illustrates a liquid injection process where the pumped injection liquid pressure 1601 is lower than estimated injection pressure 1600. Factors which affect the estimated injection pressure, include but are not limited to, technical characteristics of the injection well, hydraulic conductivity of the oil-bearing formation and distance between injection and production wells. Gas pressure spikes 1602 are generated when a gas impulse device is operated. These are superimposed on the pumped injection liquid pressure profile 1601.

The combined effect of the pumped injection liquid and the gas pressure impulses shown in FIG. 8 is to change the flow character of the injection liquid to cyclical flow and to create rapid cyclical injection liquid surges into the rock formation with liquid oscillation occurring inside the fractures and/or pores. This aids in overcoming liquid preferential flow.

Preferential flow is fluid flow through preferential flow pathways, that is, pathways having high fluid permeability, and, accordingly, lower fluid flow resistance. Because of the slow gradual pressure increase during conventional waterflooding discussed below, fluid moves principally through these preferred pathways or zones. As a result, only oil located in zones of relatively higher permeability is displaced. Zones of higher flow resistance receive less injection liquid flow.

The sudden pressure rise (1602 in FIG. 8) created by a rapid injection liquid surge in accordance with the method of the present invention for improving injection of a liquid into a rock formation is very effective in overcoming this preferential pathway limitation. It provides a more economical and effective approach in waterflooding processes.

In an embodiment of the method for improving injection of a liquid into a rock formation of the present invention discussed above, the method is used for waterflooding. Waterflooding is a method of secondary recovery in which water is injected into the reservoir formation to displace residual oil. The water from injection wells physically sweeps the residual oil outward toward nearby production wells.

During waterflooding, water is injected into wells that have substantially ceased production to displace residual oil present in those wells. The wells into which water is pumped serve as injection wells, which introduce water into the reservoir. This water displaces some of the residual oil that remains in the rock toward nearby target production wells in the same reservoir. Usually one or several oil production wells are converted into injection wells into which the water is injected. The oil and water are then pumped up and out of the production wells.

In general, pores and/or fractures in a reservoir that are filled with oil have lower relative permeability than pores and/or fractures without oil. That makes the path through oil filled pores and/or fractures particularly resistive. The favorable relative permeability of pores and/or fractures without oil make them the more attractive flow paths. This, as is known in the art, leads to fingering and channeling as water moves over paths of least resistance in the porous media. Water moving over paths of least resistance may also lead to early water breakthrough into the production wells rather than displacing oil into these wells.

Using the method for improving injection of a liquid into a rock formation described above, water is pumped through an injection well into formations as described above in conjunction with FIGS. 1-4 and 8.

Use of the method of the present invention in waterflooding operations helps in overcoming fingering. The injected fluid is periodically suddenly accelerated by gas bubbles introduced by a gas impulse device and is pushed even into paths of relatively low conductivity. Entering into the formation with the liquid, the gas bubbles oscillate the injected pressurized liquid and assist in overcoming fingering.

In some embodiments of the improved injection method discussed above and below, the method includes the step of monitoring the pressurized injection liquid pressure or the rate of injection of the injected liquid or both into the wellbore. Alternatively, or additionally, the step of monitoring may be monitoring the compressed gas pressure being supplied to the gas impulse device. As a result of the step of monitoring the method may also include the step of periodically adjusting the rate of liquid injection and/or liquid pressure and/or the compressed gas pressure being supplied to the gas impulse device used in the method of injection in accordance with the needs of the application. Often these parameters are adjusted so that they remain within a predetermined range. Monitoring of the liquid pressure or injection rate of the liquid may be effected by flow meters, pressure transducers and other pressure measuring instruments known to those skilled in the art. The parameters discussed above are only some of the parameters which may be used for monitoring. It should readily be understood by persons skilled in the art that other parameters may also be used.

In some embodiments of the improved injection method, such as that used with waterflooding as discussed above, user observation of the oil or residual oil being produced may effectively be employed as a monitoring method. Liquid pressure and/or liquid injection rate and/or compressed gas pressure supplied to the gas impulse device may then be adjusted as required.

The method of the present invention as described above for improved injection of liquid into a rock formation is also useful for injecting hazardous, industrial and municipal wastes into wells for their disposal and isolation. The method outlined above for injecting liquids, for example in waterflooding applications, can readily be adapted to deposit waste deep within a rock formation. The difference between this waste management application and that of waterflooding is that the waste is not pumped out from the formation well but left there for long-term isolation.

The method for improving the injection of a liquid into a rock formation as described above may also be used to inject pressurized sealant slurries to prevent lost circulation. One of the most costly and time-consuming drilling and cementing problems is lost circulation caused by drilling mud or cement quantities being absorbed by the oil-bearing formation. This usually occurs in cavernous, fissured, or coarsely permeable zones. It is often encountered when a drill bit passes through porous or fractured formations and as a result, in many cases, the drilling operations must be interrupted until these formations can be sealed and drilling can be resumed.

In order to treat problems arising from lost circulation, many different materials have been used or proposed to seal porous or fractured formations. Often these materials are various slurries that are effectively heterogeneous solid/liquid mixtures, the solid inter alia including cements, clays, synthetic or natural polymers or combinations thereof.

These materials for preventing lost circulation are generally applied by pumping them down to the zone of circulation loss in the form of a slurry. Sometimes pumping is not enough to provide fast, economical and effective sealing in the loss circulation zone. In many cases the cementing, i.e. sealing, fluid has a higher viscosity than the drilling or formation fluid. Uniform introduction of the cementing (sealing) fluid into a porous or fractured media filled by a fluid of lower viscosity may be a challenge and therefore there is a need for a method for forcing the particulate sealing materials in the slurry into the porous and/or fractured media. This is achievable by using the method for improving injection of a liquid into a rock formation provided by the present invention.

Reference is now made to FIG. 7 where the environment around a wellbore 820 suffering from lost circulation is shown. Gas impulse device 805 is lowered to the drilling fluid "thief" zone 828. Device 805 is connected via coil tubing 826 to a pressurized air source (not shown). Around coil tubing 826 is workstring 832 through which the sealant slurry is pumped from a particulate/liquid slurry source (not shown). Packer elements 814 and a cement plug 824 may be present to isolate the region to be sealed from the remainder of wellbore 820. Wellbore 820 typically has a casing 807 and gas impulse device 805 is positioned below casing 807 against the open wall. In some embodiments, packer elements 814 may not be needed.

Device 805 is fired and operated as discussed in conjunction with FIGS. 1-4 above. The effect of the impulses generated by firing the gas impulse device is to force the sealing slurry into pores and/or fractures (not shown) of the "thief" zone sealing them. Gas impulse device 805 can be moved up and down in wellbore 820 adjacent to the "thief" zone as often and as quickly or as slowly as required, with a firing rate adjusted to effect sealing of the zone.

In lost circulation applications, in addition to monitoring the parameters discussed above, monitoring may be effected by tracking the density of the sealant slurry being delivered into the wellbore.

In embodiments of the method for improving liquid injection into a rock formation including, but not limited to, the embodiments of waterflooding and lost circulation, the method may also include a step of estimating the pressure or injection rate of the pressurized liquid required for improving liquid flow into the formation. Typically, but without intending to limit the invention, the pressure or injection rate of the pumped pressurized liquid in the step of pumping ranges from about 25% to about 100% of the estimated injection pressure or injection rate. These parameters may be periodically adjusted so that the pumped liquid pressure or injection rate remains in that range. Additionally, typically but again without intending to limit the invention, the gas impulse device working pressure in the step of firing is at least 10 bars greater than the pumped injection liquid pressure.

It should also be evident to one skilled in the art that the method disclosed herein can be applied to stimulating aqueous flow in water wells.

It should be evident that in the discussion above and in the claims herein, the step of introducing of the gas device into the wellbore and the step of pumping a pressurized liquid into the wellbore may be effected in any order.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

It will be appreciated by persons skilled in the art that the present invention is not limited by the drawings and description hereinabove presented. Rather, the invention is defined solely by the claims that follow.

What is claimed is:

1. A method for improving fluid injection into a rock formation, the method including the following steps:

introducing a gas impulse device into a wellbore in the formation;

pumping a pressurized fluid into the wellbore;

firing the gas impulse device periodically so that the device generates impulses of high pressure compressed gas which when the gas expands through the pumped pressurized fluid substantially instantaneously increases the fluid flow rate into the rock formation, and creates rapid cyclical injected fluid surges into the rock formation with fluid oscillation occurring inside the fractures and/or pores of the formation, where the impulse device firing pressure is at least 10 bars greater than the pressure of the pumped pressurized fluid; and monitoring at least one parameter affecting the pressure of the pressurized fluid.

2. A method according to claim 1 wherein said step of pumping a pressurized fluid is pumping a fluid that comprises hazardous, industrial and/or municipal wastes.

3. A method according to claim 1 wherein said rock formation is an oil containing rock formation.

4. A method according to claim 3, wherein said step of monitoring includes monitoring at least one of the following parameters: the pressure of the pumped pressurized fluid; the injection rate of the pumped pressurized fluid; the pressure of the gas being supplied to the gas impulse device; and oil production in at least one production well in the oil containing rock formation.

5. A method according to claim 4, further including a step of periodically adjusting at least one of the following based on the results of the step of monitoring:

the pressure of the pressurized fluid;

the injection rate of the pressurized fluid; and the pressure of the compressed gas supplied to the gas impulse device.

6. A method according to claim 1, wherein said method is employed for extracting residual oil in an oil formation in which oil production has substantially ceased, and where said step of introducing a gas impulse device into a wellbore, includes introducing the device into a wellbore in a formation where oil production has substantially ceased, and wherein said step of firing the gas impulse device periodically generates impulses of high pressure compressed gas which when the gas expands through the pumped pressurized fluid substantially instantaneously increases the pressurized fluid flow rate into the oil formation causing residual oil found in fractures and/or pores, including fractures and/or pore having high flow resistance, to be displaced and flow toward and empty into nearby producing wells.

7. A method according to claim 6, wherein said step of monitoring includes monitoring at least one of the following parameters: the pressure of the pumped pressurized fluid; the injection rate of the pumped pressurized fluid; the pressure of the gas being supplied to the gas impulse device; and the rate of discharged residual oil.

8. A method according to claim 7, further including a step of periodically adjusting at least one of the following parameters based on the results of the step of monitoring: the pressure of the gas supplied to the gas impulse device; the pressure of the injected pressurized fluid; and the injection rate of the injected pressurized fluid.

9. A method according to claim 6 where in said step of introducing, the gas impulse device is positioned at, or above, a level of one of the following: i) perforations in a well casing of the wellbore; ii) a well screen positioned in the wellbore; and iii) the wellbore-rock formation interface.

10. The method according to claim 1, said method used for preventing drilling fluid lost circulation, where in said step of introducing a gas impulse device into a wellbore in the formation, the formation at least partially includes a drilling fluid thief zone, and where in said step of pumping a pressurized fluid, the pressurized fluid is a pressurized sealing slurry which when pumped into the wellbore covers at least a portion of the thief zone, and where in said step of firing the gas impulse device, the device expels gas which expands through the slurry substantially instantaneously increasing the slurry flow rate into the formation causing fissured and porous regions of the formation to be sealed with the sealing slurry.

11. A method according to claim 10, said method further including a step of moving the device along the thief zone so that the gas impulse device is fired all along the zone so that the sealing slurry can enter the fissures and porous regions throughout all portions of the thief zone.

12. A method according to claim 10, wherein said step of monitoring includes monitoring at least one of the following parameters: the pressure of the pumped pressurized sealing slurry; the injection rate of the pumped pressurized sealing slurry; pressure of the gas being supplied to the gas impulse device; and the density of the pressurized sealing slurry.

13. A method according to claim 12, further including a step of periodically adjusting at least one of the following parameters based on the pressure, rate and/or density determined in said step of monitoring: the pressure of the pressurized sealing slurry; the injection rate of the pressurized sealing slurry; the density of the pressurized sealing slurry; and the pressure of the compressed gas supplied to the gas impulse device.

14. A method according to claim 1, further including a step of periodically adjusting the impulse device firing pressure based on the results of said step of monitoring so that its firing pressure is maintained at least 10 bars greater than the pressure of the pumped pressurized fluid.

15. A method according to claim 14, wherein said step of periodically adjusting includes adjusting at least one of the following parameters based on the results of said step of monitoring:

the pressure of the pressurized fluid;

the injection rate of the pressurized fluid; and the pressure of the compressed gas supplied to the gas impulse device.

16. A method according to claim 1 wherein said step of monitoring includes monitoring at least one of the following parameters:

the pressure of the pressurized fluid;

the injection rate of the pressurized fluid; and the pressure of the compressed gas supplied to the gas impulse device.

17. A method for reducing drilling fluid loss in a rock formation, the method including the steps of:

introducing a gas impulse device into a wellbore in the formation, the wellbore containing a fluid characterized by a first viscosity and the formation at least partially including a drilling fluid thief zone;

pumping a pressurized liquid into the wellbore so as to cover at least a portion of the thief zone, said pressurized liquid characterized by a second viscosity which is greater than the first viscosity; and firing the gas impulse device periodically so that the device generates impulses of high pressure compressed gas which when the gas expands through the pumped pressurized liquid substantially instantaneously increases the pressurized liquid flow rate into the rock formation causing fissured and porous regions of the formation to be sealed by the pumped pressurized liquid.

18. A method according to claim 17, wherein said pumped pressurized liquid is a sealing slurry.

19. A method according to claim 18, said method further including a step of moving the gas impulse device along the thief zone so that the device is fired all along the zone so that the sealing slurry can enter the fissures and porous regions throughout all portions of the thief zone.

20. A method according to claim 18, further including a step of monitoring at least one of the following: the pressure of the pumped pressurized liquid; the injection rate of the pumped pressurized liquid; the pressure of the gas supplied to the gas impulse device; and the density of the pumped pressurized liquid.

21. A method according to claim 20, further including a step of periodically adjusting at least one of the following parameters based on the results of said step of monitoring: the pressure of the pumped pressurized liquid; the injection rate of the pumped pressurized liquid; the density of the pumped pressurized liquid; and the pressure of the compressed gas supplied to the gas impulse device, where said adjustment is based on the pressure, rate and/or density determined in said step of monitoring.

22. A method for displacing residual hydrocarbons from a rock formation, the method including the steps of:

introducing a gas impulse device into a wellbore in the formation;

pumping a pressurized fluid into the wellbore; and displacing residual hydrocarbons into nearby production wells with the pumped pressurized fluid by firing the gas impulse device periodically so that the device generates impulses of high pressure compressed gas which when the gas expands through the pumped pressurized fluid substantially instantaneously increases the pressurized fluid flow rate into the rock formation, thereby creating rapid cyclical pressurized fluid surges into the rock formation, including pores and fractures in the rock formation characterized by low relative permeability; and pumping a mixture of residual hydrocarbons and pressurized fluid out of the nearby production wells into which the hydrocarbons have been displaced.

23. A method according to claim 22, wherein said method is employed for displacing and extracting residual oil in an oil formation in which oil production has substantially ceased, and wherein said step of firing the gas impulse device periodically generates impulses of high pressure compressed gas which when the gas expands through the pumped pressurized fluid substantially instantaneously increases the pressurized fluid flow rate into the oil formation displacing residual oil found in fractures and/or pores, including fractures and/or pores having high flow resistance, causing the residual oil to flow toward and empty into nearby producing wells.

24. A method according to claim 23, further including a step of monitoring the rate of discharged of residual oil.

25. A method according to claim 24, further including a step of periodically adjusting at least one of the following parameters based on the results of the monitored rate of discharged of residual oil: the pressure of the gas supplied to the gas impulse device; the pressure of the pumped pressurized fluid; and the injection rate of the pumped pressurized fluid.

26. A method according to claim 22, further including a step of monitoring at least one of the following parameters: the pressure of the pumped pressurized fluid; injection rate of the pumped pressurized fluid; and the pressure of the gas supplied to the gas impulse device.

27. A method according to claim 26, further including a step of periodically adjusting at least one of the following parameters based on the results of said step of monitoring: the pressure of the pumped pressurized fluid; the injection rate of the pumped pressurized fluid; and the pressure of the gas supplied to the gas impulse device.

28. A method according to claim 22, where in said step of introducing, the gas impulse device is positioned at, or above, a level of one of the following: i) perforations in a well casing of the wellbore; ii) a well screen positioned in the wellbore; and iii) the wellbore-rock formation interface.

* * * * *